US007134990B2

(12) United States Patent
Wischusen

(10) Patent No.: US 7,134,990 B2
(45) Date of Patent: Nov. 14, 2006

(54) ROLLER FOR BALANCING DEVICES

(76) Inventor: Henry Wischusen, 756 Sunset Dr., Norcross, GA (US) 30071

( * ) Notice: Subject to any disclaimer, the term of this patent is extended or adjusted under 35 U.S.C. 154(b) by 0 days.

(21) Appl. No.: 10/259,123

(22) Filed: Sep. 27, 2002

(65) Prior Publication Data

US 2004/0063556 A1 Apr. 1, 2004

(51) Int. Cl.
*A63B 71/00* (2006.01)

(52) U.S. Cl. ..... 482/148; 441/74; 472/88

(58) Field of Classification Search ..... 482/148, 482/79, 80, 77, 147, 34, 132, 104–108, 51, 482/907, 35, 23, 36–37, 28; 108/171; 119/69.5, 119/74; D30/123; 368/93; 206/551, 45; 312/283; D07/610, 673; 249/DIG. 1; 99/47; D35/3; D22/122; 215/99.5; 239/17, 28; 182/179.1, 141, 129, 187, 20, 222; D25/162, D25/68; 248/235; D21/760–761; 280/600, 280/841; 472/88; 441/74
See application file for complete search history.

(56) References Cited

U.S. PATENT DOCUMENTS

| | | | | | |
|---|---|---|---|---|---|
| 145,145 | A * | 12/1873 | Baggs | ..... | 119/69.5 |
| 4,107,830 | A * | 8/1978 | Thomson | ..... | 29/110.5 |
| 4,826,159 | A * | 5/1989 | Hersey | ..... | 272/146 |
| 5,643,182 | A * | 7/1997 | Engel | ..... | 601/119 |
| 6,017,297 | A * | 1/2000 | Collins | ..... | 482/146 |

* cited by examiner

*Primary Examiner*—Lori Amerson
(74) *Attorney, Agent, or Firm*—Harry I. Leon; Vivian L. Steadman

(57) ABSTRACT

An elongated roller which can be used with a balance board to provide exercising and recreational opportunities for consumers. The roller has a smooth outer surface and a curvature such that the transverse cross-sectional diameter changes smoothly lengthwise. The consumers have complete freedom to move the board relative to the roller and can enjoy a wide variety of movement.

6 Claims, 4 Drawing Sheets

FIG. 2
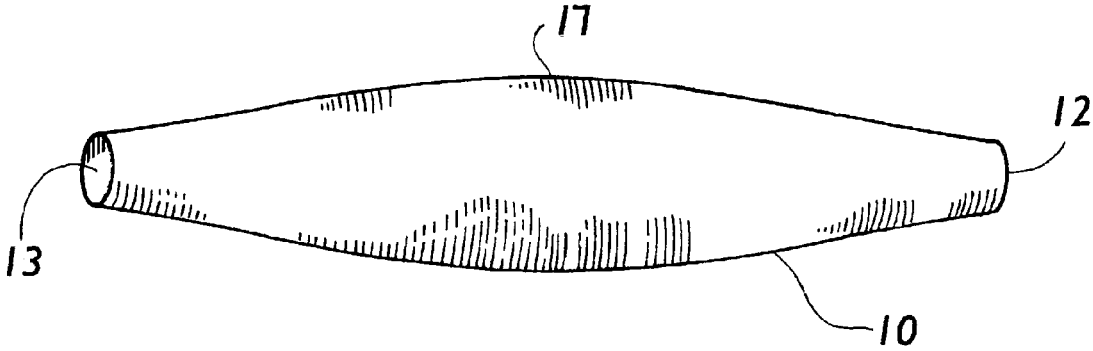
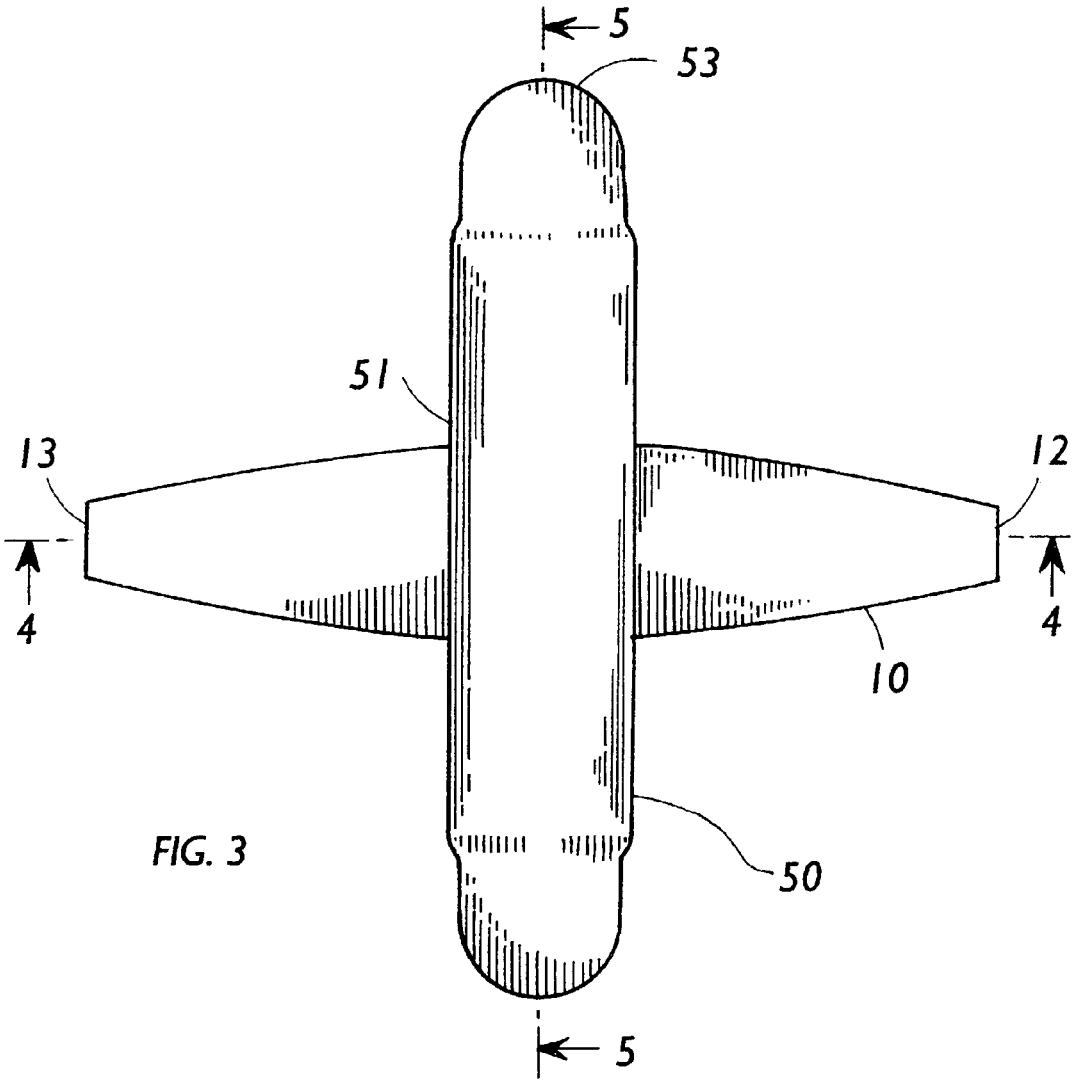
FIG. 3

FIG. 4
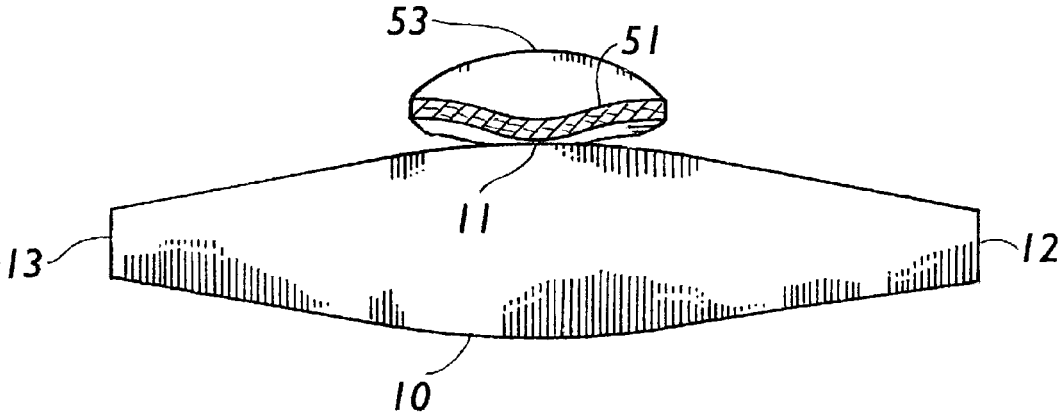
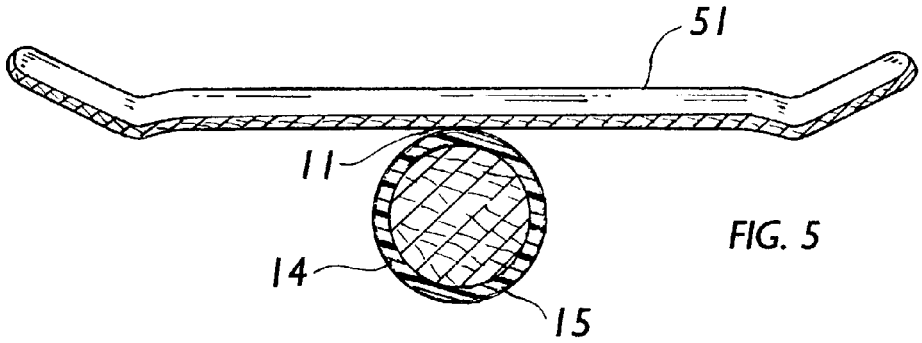
FIG. 5
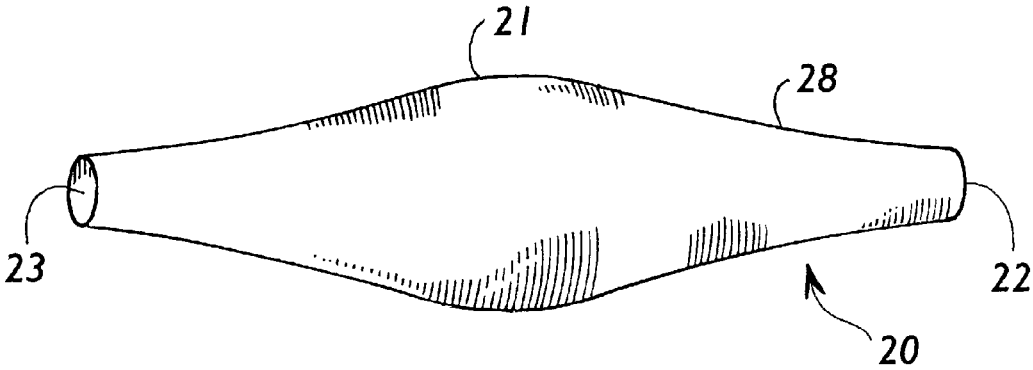
FIG. 6

FIG. 7
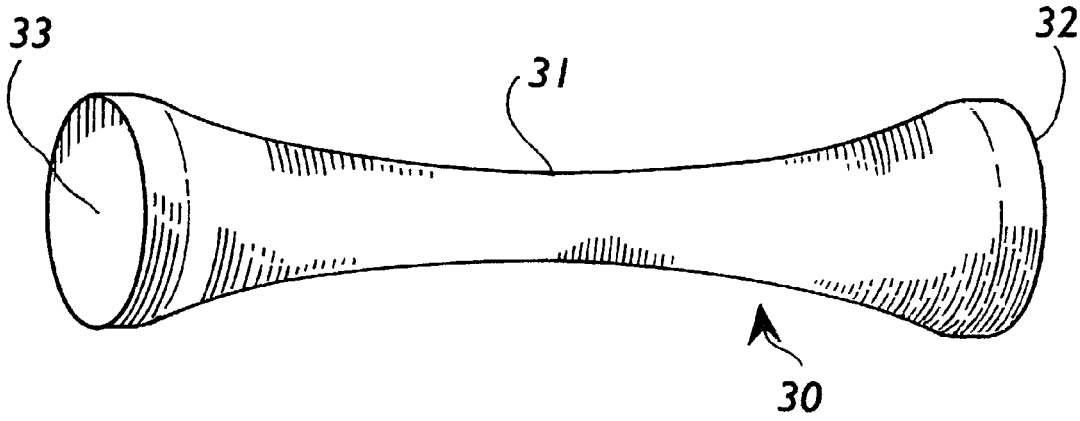
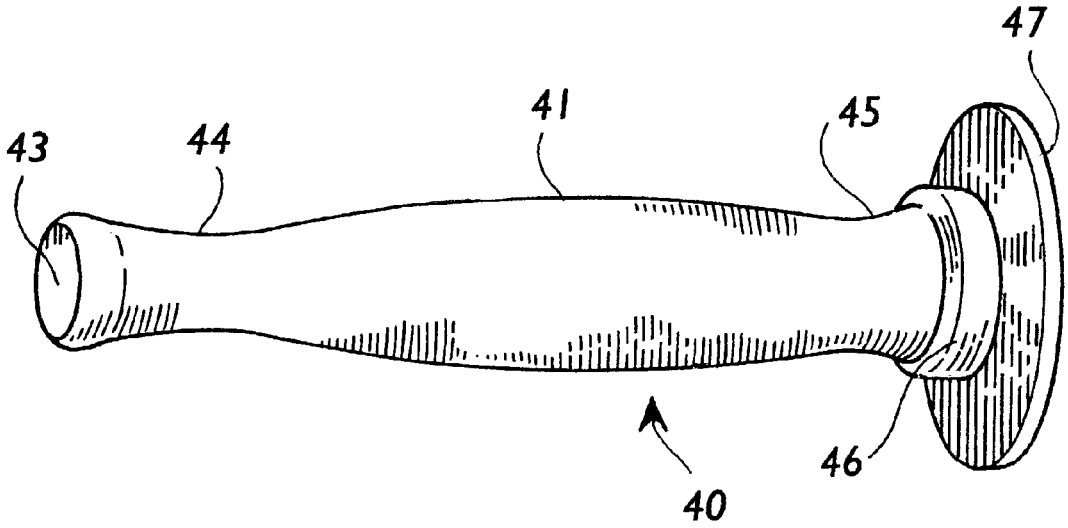
FIG. 8

ROLLER FOR BALANCING DEVICES

FIELD OF THE INVENTION

This invention relates in general to balancing devices for exercising and amusement, and more particularly to an elongated roller whose transverse cross sectional diameter changes lengthwise.

BACKGROUND OF THE INVENTION

Numerous balancing devices comprising a balance board and a roller are available on the market. For example, U.S. Pat. No. 6,019,712 discloses a platform which tilts upon a hemisphere attached to the underside thereof. The platform also has a grooved tract along its periphery wherein is placed a movable ball. A consumer can amuse himself while tilting upon the platform and causing the ball to move along the track. U.S. Pat. No. 5,152,691 discloses a roller having a slot in the center thereof and tapered end sections. A board having a guide rail attached to its horizontal center line is in the slot and moves within a limited range relative to the roller. U.S. Pat. No. 5,190,506 discloses a deck and a roller assembly comprising two wheels mounted on a common axle. A cable maintains a contact between the deck and the roller assembly and limits the longitudinal displacement of the deck relative to the roller assembly. U.S. Pat. No. 4,911,440 discloses a roller, a board normally resting on the roller, and a releasable connector interconnecting the board and the roller. The connector maintains the roller perpendicular to the longitudinal axis of the board, thereby limiting the longitudinal movement of the board relative to the roller. U.S. Pat. No. 4,826,159 discloses a cylindrical roller having a coarse surface and a balance board having a pair of tracts and stops so as to limit the movement of the board relative to the roller. U.S. Pat. No. 4,601,469 discloses a balance board having a foot platform and a roller retained in a frame underneath the platform by a pin extending through the roller and into guide channels formed underside of the frame. U.S. Pat. No. 4,191,371 discloses a spherical fulcrum and a board having a flat top for foot support and a pair of stop means attached to the underside of the board so as to limit the extent of movement of the spherical fulcrum with respect to the platform. U.S. Pat. No. 3,895,794 discloses a balance board and a cylindrical roller which is confined within a cavity formed near a center portion of the board. U.S. Pat. No. 3,389,910 discloses a cylindrical base and a board having a tally scale on the side of the board. The consumers can compare, using the tally scale, the length of the board they can shift relative to the longitudinal center line of the roller.

In sum, prior art balancing devices limit the movement of the board relative to the roller. What is needed is a balancing device providing complete freedom of movement of the board relative to the roller.

SUMMARY OF THE INVENTION

The object of the present invention is to provide a roller for use with a conventional balance board so that consumers can enjoy a variety of motions while riding the board on the roller. The consumers have complete freedom to move the board relative to the roller.

In accordance with the present invention, there is provided an elongated roller whose transverse cross-sectional diameter changes lengthwise. In one embodiment, the transverse cross-sectional diameter increases smoothly from each distal end to a generally longitudinal mid-point of the roller. In this embodiment, the rate of change in the diameter is generally uniform, and the top curvature of the roller, when seen lengthwise in a plan view, forms a convex line.

To use the invention, the consumer rides an elongated board having a smooth bottom on the roller. Because of the changing transverse cross-sectional diameter, the roller, when in use, makes a single point of contact with the bottom surface of the board. This contact point forms the pivotal point about which the consumer can manipulate the board relative to the roller with complete freedom. A desirable coefficient of friction between the bottom surface of the board and the surface of the roller is in the range between 0.5 and 1.6.

Alternatively, the transverse cross-sectional diameter changes at different rates along the length of the elongated roller. In particular, while the cross-sectional diameter increases from either distal end to a generally longitudinal mid-point, the rate of the change is the lowest near a region about one-fourth of the length of the roller inward from either end. As a result, the roller has a smooth surface curvature which includes a convex region near the mid-point and a concave region between the mid-point and either distal end.

In yet another embodiment, the transverse cross-sectional diameter of the roller decreases smoothly from each distal end to a generally longitudinal mid-point. The roller has a smooth top surface which forms, when seen lengthwise in a plan view, a concave line.

In a further alternate embodiment, the transverse cross-sectional diameter of the roller changes lengthwise without following a general rule. Starting from one end of the roller, the cross-sectional diameter decreases, increases, then decreases and so forth so as to provide a rapidly changing surface curvature on which the consumer can ride his balance board. In this embodiment, a disk whose diameter is larger than the largest transverse cross-sectional diameter of the roller is attached to one end so as to provide some stability and allow the roller to roll on a surface.

BRIEF DESCRIPTION OF THE DRAWINGS

FIG. 2 is a perspective view of the roller according to the present invention;

FIG. 3 is a plan view of an elongated board resting upon the roller according to FIG. 2;

FIG. 4 is a view partly in cross-section of the elongated board resting upon the roller according to FIG. 3, the cross-sectional portion being taken along line 4—4 of FIG. 3 and showing only the elongated board;

FIG. 5 is a cross-sectional view taken along line 5—5 of FIG. 3; and FIGS. 6, 7 and 8 are perspective views of further alternate embodiments of the roller according to the present invention.

DETAILED DESCRIPTION OF THE INVENTION

Figure 1:
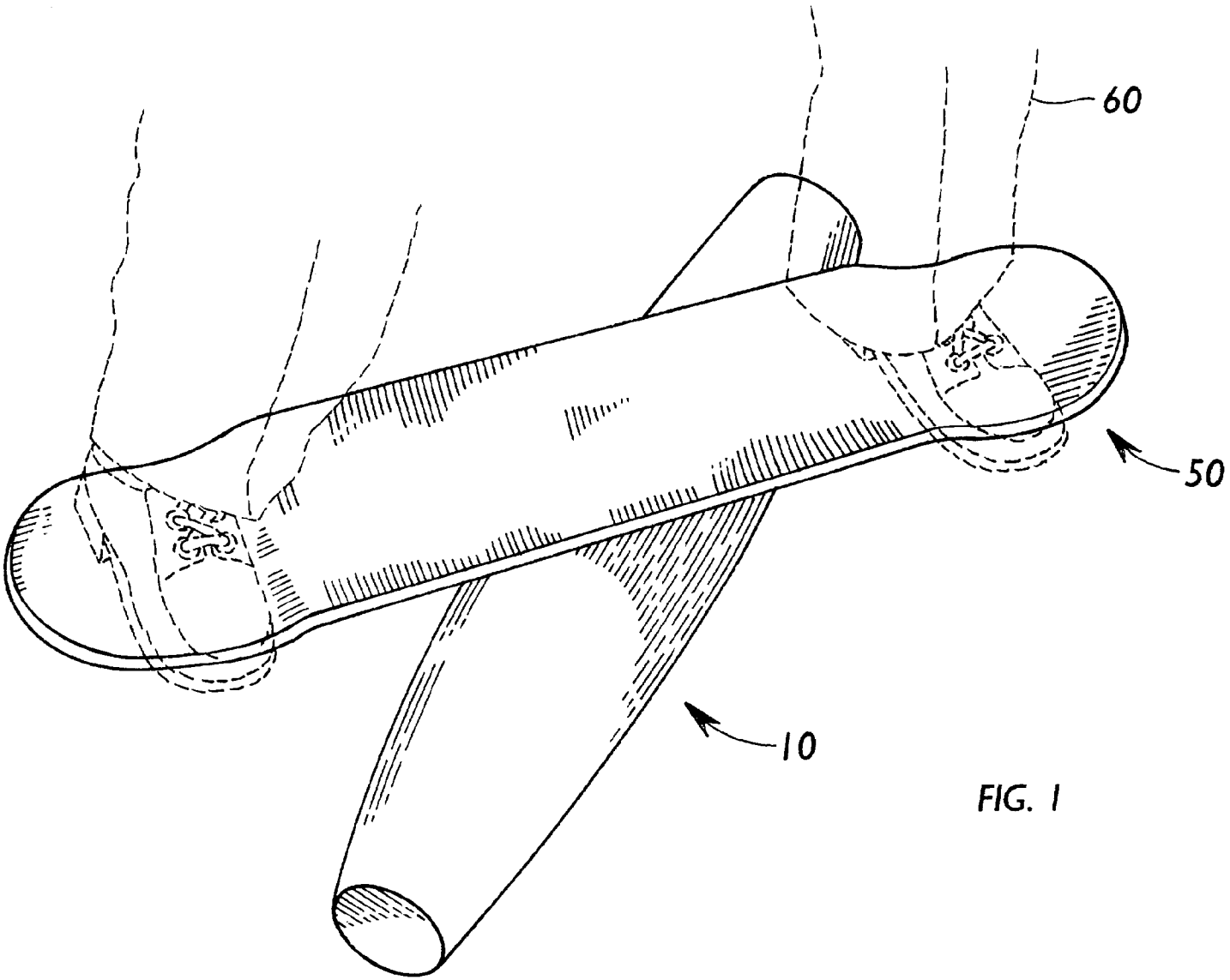
FIG. 1 is a perspective view of a balancing device according to the present invention, a consumer maintaining his balance on an elongated, conventional board being shown in dashed lines and forming no part of the invention.

In the drawings, an elongated roller for balancing devices according to the present invention is indicated generally by the reference numeral 10. Used with the roller 10 is an elongated, conventional balance board 50, which a consumer 60 rides on the roller and maintains his balance for exercising and amusement (FIG. 1).

The balance board 50 can be any generally available elongated board having a smooth bottom surface that a consumer can use to ride on the roller 10. Preferably, seen when it is right side up, the elongated board 50 has a concave bottom surface. In particular, the peripheral region 51 curves upward from the longitudinal center line of the board, and, as a general rule, the distal ends of the board, generally indicated by the reference numeral 53, are curved upward so as to aid the consumer to stop the movement of the board by tipping the board toward one of the distal ends (FIGS. 3, 4 and 5). As those skilled in the art will understand, the degree of concaveness for the bottom surface of the board 50 can vary, including a substantially flat bottom surface.

As illustrated in FIG. 2, the elongated roller 10 has a generally smooth outer surface and transverse cross-sections which are generally circular in shape and change in diameter along the length of the roller. In particular, starting from either of distal ends 12, 13, the transverse cross-sections increase smoothly in diameter lengthwise until a generally longitudinal mid-point 17 is reached. As illustrated in FIGS. 1 through 4, a smooth surface and a curvature are formed for the roller 10 as the result of the changing diameters of the transverse cross-sections. When seen lengthwise in a plan view, the top outer surface of the roller 10 (the surface contacting the board) forms a convex curve and the bottom outer surface of the roller 10 (the surface contacting the ground) forms a concave curve (FIG. 4).

The smooth surface and the curvature of the roller are important because they allow the roller to have a single point of contact 11 with the bottom surface of the board 50 when a consumer rides the board on the roller 10 (FIG. 4). The single point of contact is formed regardless of where on the roller's surface the balancing board is disposed. The point of contact forms a pivotal point about which the user can manipulate the board relative to the roller in complete freedom.

Unlike prior art devices, the balancing device using the roller 10 does not include any structural element to limit the movement of the board relative to the roller. The consumer has complete freedom of movement of the board 50 relative to the roller 10. In addition, while riding the board on the roller, the consumer can manipulate the speed with which he must react, because the number of revolutions the roller must make, given a constant force applied, depends on the size of the transverse cross-sections. The consumer must be able to react faster when he is riding the board near the ends where the cross-sections have relatively small diameters than when he is riding the board near the mid-section of the roller, where the cross-sections have relatively large diameters. Furthermore, the smooth outer surface and the curvature of the roller 10 allow the consumer to enjoy movement of the board along an arc or a curved path, in addition to a linear path. The consumer can, of course, rock and jump from the board while riding the board on the roller.

The elongated roller 10 works together with the balance board 50 to provide a balancing device according to the present invention because of the coefficient of friction existing between the bottom surface of the board and the outer surface of the roller. In particular, the frictional coefficient must be so as to prevent the board from sliding off when the bottom surface of the board is contacting lengthwise a region of the roller between the mid-point and either distal end. A coefficient of friction in the range between 0.5 and 1.6 is desirable.

As illustrated in FIG. 5, the roller 10 can include an inner structural element 14 whose hardness can support the force applied thereto by the consumer. So that a desired coefficient of friction may be achieved, the roller also can include an outer coating element 15 disposed on the inner structural element. The inner element is preferably made of wood and the outer coating element is preferably of plastic such as polyurethane. As those skilled in the art will understand, the elongated roller can be made out of wood, fiberglass, aluminum, and the like. The roller can also be air-filled or made of several sub-sections or subelements.

The size of the roller 10 can vary depending on the size of the consumers. As a general rule, for an adult user, the length of the roller 10 measures about thirty (30) to thirty-five (35) inches, the transverse cross-sectional diameter near the midpoint 17 measures about seven (7) inches, and the transverse cross-sectional diameter near either end measures about three (3) inches.

An alternate embodiment is shown in FIG. 6. An elongated roller 20 also has a smooth outer surface and transverse cross-sections which are generally circular in shape and increase smoothly in diameter from either distal end 22, 23 to a generally longitudinal mid-point 21. However, in contrast to the roller 10, the degree of change in the transverse cross-sectional diameters is not uniform, but varies along the length of the roller 20. In particular, the rate at which the cross sectional diameters increase is smaller near the sections indicated generally by reference numeral 28 (about one-fourth of the length of the roller inward from either distal end) than near the distal ends 22, 23 or near the mid-point 21 (FIG. 6). The resulting surface curvature for the roller 20 includes concave regions near 28 and a convex region near the mid-point 21. When seen lengthwise in a plan view, the top surface of roller 20 (the surface on which the board would be disposed) forms a curve having a convex segment near the mid-point 21 and concave segments corresponding to the sections indicated by 28.

Yet another alternative is shown in FIG. 7. Illustrated there is an elongated roller 30 which has a smooth outer surface and transverse cross-sections which are generally circular in shape and decrease smoothly in diameter from either of distal ends 32, 33 until a generally longitudinal mid-point 31 is reached. In particular, when seen lengthwise in a plan view, the top surface of the roller 30 (the surface on which a board would be disposed) forms a concave curve.

As with the roller 10, the size of the roller 30 can vary depending on the size of the consumers. As a general rule, for an adult user, the length of the roller measures about thirty (30) to thirty-five (35) inches, the transverse diameter of the roller near the either end measures about seven (7) inches, and the diameter near the mid-point measures about three (3) inches.

A further alternate embodiment is shown in FIG. 8. An elongated roller 40 has a smooth outer surface and transverse cross-sections which are generally circular in shape and change smoothly in diameter along the length of the roller. In this embodiment, the transverse cross-sectional diameters change without generally being reflective about the mid-point 41 of the roller. In particular, starting from one end 43, the diameters of the transverse cross-sections may increase and then decrease to a minimum diameter 44 and then increase and so forth without regard to the mid-point 41. Thus, along the length of the roller 40, a free flowing surface curvature is formed, thereby providing consumers with a rapidly changing surface curvature on which they can ride a balance board. An end disc 47, whose diameter is larger than the largest diameter of the transverse cross-sections, is attached to one end 45 to provide some stability and allow the roller 40 to roll on a surface. A ring-like support 46 is provided to further securely attach the end disk 47 to the end 45. Again, the size of the roller 40 can vary depending on the size of the consumers. As a general rule, for an adult user, the length of the roller 40 measures about thirty (30) to thirty-five (35) inches, the transverse cross-sectional diameter at 43 and 41 measures about 3 and 4.5 inches, respectively, and the diameter of the end disk 47 measures about 12 inches.

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the embodiment may be varied without departing from the spirit of the invention, and the exclusive use of all modifications which come within the scope of the appended claims is reserved.

What is claimed is:

1. A balancing device comprising:

an elongated balance board having a longitudinal centerline; and an elongated roller having a generally smooth surface, each transverse cross-section being generally circular in shape, the transverse cross-sections increasing smoothly in diameter from each distal end of the roller to a generally longitudinal midpoint of the roller, wherein the board has a single point of contact with the roller, said point of contact forming a pivotal point about which a user can reorient the longitudinal centerline of the board relative to the rotational axis of the roller while the user, riding on the board, balances his weight on the balancing device, distal ends of the board remaining movable during use about the point of contact even when the longitudinal centerline of the board is disposed at an angle to the rotational axis of the roller which is substantially less than 90 degrees.

2. The balancing device according to claim 1, wherein the diameter of the transverse cross-sections changes along the length of the roller at at least two different rates so as to form a concave region in the surface of the roller.

3. A balancing device comprising:

an elongated balance board having a longitudinal centerline; and an elongated roller having a generally smooth surface, each transverse cross-section of the roller being generally circular in shape, the transverse cross-sections decreasing smoothly in diameter from each distal end of the roller to a generally longitudinal mid-point of the roller, wherein the board has a single point of contact with the roller, said point of contact forming a pivotal point about which a user can reorient the longitudinal centerline of the board relative to the rotational axis of the roller while the user, riding the board, balances his weight on the balancing device, distal ends of the board remaining movable during use about the point of contact even when the longitudinal centerline of the board is disposed at an angle to the rotational axis of the roller which is substantially less than 90 degrees.

4. A balancing device comprising:

an elongated balance board having a longitudinal centerline; and an elongated roller having a generally smooth surface, each transverse cross-section being generally circular in shape, the transverse cross-sections changing smoothly in diameter along the length of the roller, wherein the board has a single point of contact with the roller, said point of contact adaptively moving lengthwise across the surface of the roller and forming a pivotal point about which a user can reorient the longitudinal centerline of the board relative to the rotational axis of the roller while the user, riding on the board, balances his weight on the balancing device, distal ends of the board remaining movable during use away from an orientation in which the longitudinal centerline of the board is disposed perpendicularly to the rotational axis of the roller.

5. The balancing device according to claim 4, which further comprises means, dependent upon the orientation of the longitudinal centerline of the board relative to the rotational axis of the roller, for adjusting how fast changes in the rate of revolution of the roller occur as the board traverses the surface of the roller lengthwise.

6. The balancing device according to claim 4, wherein any specific orientation between the longitudinal centerline of the board and the rotational axis of the roller is generally short-lived as the user shifts his weight to maintain his balance while riding the board.

* * * * *